US006138560A

United States Patent [19]

Chen

[11] Patent Number: 6,138,560

[45] Date of Patent: Oct. 31, 2000

[54] SLIDE MECHANISM AND A DRIVING MECHANISM THEREOF FOR A CANTILEVER TYPE SCREEN-PRINTING MACHINE

[76] Inventor: Tung-Chin Chen, No. 65, Wuchuen 7th Road, WuKu Industrial Area, Taipei Heien, Taiwan

[21] Appl. No.: 09/302,448

[22] Filed: Apr. 30, 1999

[51] Int. Cl.[7] ..... B05C 17/04

[52] U.S. Cl. ..... 101/123; 101/114

[58] Field of Search ..... 101/114, 123, 101/124, 126, 127.1, 129

[56] References Cited

U.S. PATENT DOCUMENTS

| | | | |
|---|---|---|---|
| 4,817,523 | 4/1989 | Harpold et al. | 101/123 |
| 5,694,843 | 12/1997 | Chen | 101/123 |
| 5,857,409 | 1/1999 | Derrickson | 101/123 |

*Primary Examiner*—Ren Yan
*Attorney, Agent, or Firm*—Dougherty & Troxell

[57] ABSTRACT

A slide mechanism for a cantilever type screen-printing machine and a driving mechanism for elevating the slide mechanism are provided. The slide mechanism includes an elevating mechanism and a transverse sliding assembly both including members formed from aluminum extrusions and therefore having high rigidity and strength. The transverse sliding assembly is vertically adjustably connected to a guide block through two small slide pairs connected between the transverse sliding assembly and the guide block, and the guide block is in turn connected to two big slides of the elevating mechanism. The driving mechanism includes a gear reduction motor, a driving bar of which is connected to the guide block in order to drive the transverse sliding assembly to stably move up and down along the elevating mechanism at high speed to achieve high precision printing in high efficiency.

9 Claims, 14 Drawing Sheets

SLIDE MECHANISM AND A DRIVING MECHANISM THEREOF FOR A CANTILEVER TYPE SCREEN-PRINTING MACHINE

BACKGROUND OF THE INVENTION

The cantilever type screen-printing machine is an important printing apparatus in the printing industry, and is particularly suitable for precision printing of circuit boards. The cantilever type screen-printing machine basically includes a base, a printing tabletop at a front portion of a top surface of the base, two cylindrical columns spaced at rear side of the base to serve as elevating rails, a transverse sliding assembly connected to and forward projected from the elevating rails to move up and down along the elevating rails, a printing head assembly connected to and forward projected from the transverse sliding assembly to move leftward and rightward along the transverse sliding assembly, and two cantilever arms separately connected to and forward projected from two ends of the transverse sliding assembly for supporting two screen plate holders thereon. With these components, it is possible to proceed printing on the printing tabletop through screen plates. Since the transverse sliding assembly, the printing head assembly, the cantilever arms, and the screen plate holders of the printing machine all are forward extended to locate in front of the elevating rails, and the elevating rails bear all loads of the components connected thereto, the printing machine is referred to as a cantilever type printing machine. Most of the currently available cantilever type screen-printing machines have similarly structured elevating rails and transverse sliding assembly that have become a standardized design of the screen-printing machines. However, following disadvantages are found in the above-described elevating rails and transverse sliding assembly for the currently available screen-printing machines:

1. The elevating rails includes two spaced cylindrical columns that tend to slightly bend forward due to insufficient rigidity when all the forward projected components connected to the front of the elevating rails are elevated along the elevating rails to a certain height from the printing tabletop. Actual measurement indicates that the magnitude of bending of the cylindrical columns under loads is in the range from 0.1 mm to 0.2 mm that is serious enough to adversely affect the high precision printing and prevent all the components forward projected from the elevating rails from smoothly moving up and down at high speed.
2. Most of the transverse sliding assemblies for the conventional screen-printing machines are made of molded cast aluminum and have insufficient rigidity. In the case of providing a lengthened travel for the printing head, the conventional transverse sliding assemblies tend to deform and can not allow the printing head assembly to move along it at high speed. Moreover, the transverse sliding assembly formed from cast aluminum does not provide internal space for easy and good connection and/or mounting of other necessary components to the transverse sliding assembly. Components connected to outer surface of the transverse sliding assembly tend to be damaged during the printing operation.
3. Being limited by formations of the elevating rails and the transverse sliding assemblies, the conventional screen-printing machine is pneumatically driven. The pneumatic driving mechanism provides insufficient brake force and speed that apparently fails to meet nowadays printing industry that asks for high speed, high productivity, and high efficiency.

4. The conventional screen-printing machine usually has a pint thickness fine adjustment mechanism that includes a hand wheel mounted on a top of the elevating rails and a long screw rod connected at an upper end to the hand wheel and at a lower end to a cylinder seat. By turning the hand wheel, a cylinder on the cylinder seat and the transverse sliding assembly driven by the cylinder are finely adjusted in their vertical position. Since the hand wheel is located at a very high position on the top of the elevating rails, it can not be easily accessed and operated to accurately control the fine adjustment.

SUMMARY OF THE INVENTION

It is therefore a primary object of the present invention to provide an improved sliding mechanism for the cantilever type screen-printing machine. The improved sliding mechanism includes an elevating mechanism having two symmetrically identical and oppositely positioned aluminum extrusion columns, and a transverse sliding assembly also formed from differently structured aluminum extrusions. The aluminum extrusions have differently structured cross sections to allow convenient and stable mounting of other components and/or accessories of the printing machine in the columns of the elevating mechanism and the transverse sliding assembly. The whole sliding mechanism can therefore have reduced weight but sufficient rigidity to meet the requirement of high-speed and high-precision printing.

Another object of the present invention is to provide an improved driving mechanism for elevating and lowering the transverse sliding assembly of the cantilever type screen-printing machine. The driving mechanism includes a gear reduction motor mounted at a lower portion of the base of the printing machine. The gear reduction motor has a driving bar pivotally connected to a guide block that interconnects the transverse sliding assembly and the elevating mechanism of the screen-printing machine. Whereby the operation of the gear reduction motor would cause the transverse sliding assembly to move up and down at high speed along the columns of the elevating mechanism.

A further object of the present invention is to provide improved sliding mechanism and driving mechanism thereof for the cantilever type screen-printing machine. The sliding mechanism includes an elevating mechanism and a transverse sliding assembly that is indirectly connected to the elevating mechanism via a guide block. Two slide pairs are provided at two ends of the guide block. One of the two slides in each pair is connected to the transverse sliding assembly while the other one is connected to the guide block, such that the transverse sliding assembly is finely adjustable in its vertical position relative to the guide block. The driving mechanism includes a gear reduction motor, a driving bar of which is pivotally connected to the guide block. Whereby, when the motor operates, the guide block and accordingly the transverse sliding assembly are brought by the driving bar of the motor to move up and down along the columns of the elevating mechanism. By further finely adjusting the vertical position of the transverse sliding assembly relative to the guide block through the two slide pairs, a desired print thickness on the printing machine can be easily obtained.

To achieve the above and other objects, the present invention mainly includes a slide mechanism and a driving mechanism for elevating the slide mechanism. The slide mechanism includes an elevating mechanism and a transverse sliding assembly. The elevating mechanism includes two symmetrical and upstanding columns and the transverse sliding assembly includes a horizontal main seat. The columns and the main seat all are made of aluminum extrusions and therefore give the elevating mechanism and the transverse sliding assembly enhanced rigidity and strength. The main seat is vertically adjustably connected to a guide block through two small slide pairs connected between the main seat and the guide block, and the guide block is in turn connected to two big steel slides slidably mounted on sliding rails connected to the columns of the elevating mechanism.

The driving mechanism includes a gear reduction motor, a driving bar of which is connected to the guide block in order to drive the transverse sliding assembly connected to the guide block to stably move up and down along the columns of the elevating mechanism at high speed to achieve high precision printing in high efficiency. The small slide pairs each include two slidably associated vertical slides separately connected to the main seat and the guide block, so that the main seat may be finely adjusted in its vertical position relative to the guide block to define a desired print thickness. The aluminum extrusions forming the transverse sliding assembly provide sufficient internal hollow channels for accommodation of related parts, such as pneumatic tubes, electric conductors, photo switches, etc. With these arrangements, a print head assembly mounted on the transverse sliding assembly of the screen-printing machine is allowed to stably move upward, downward, and sideward at high speed and high precision to achieve accurate printing.

DETAILED DESCRIPTION OF THE PREFERRED EMBODIMENTS

Figure 1:
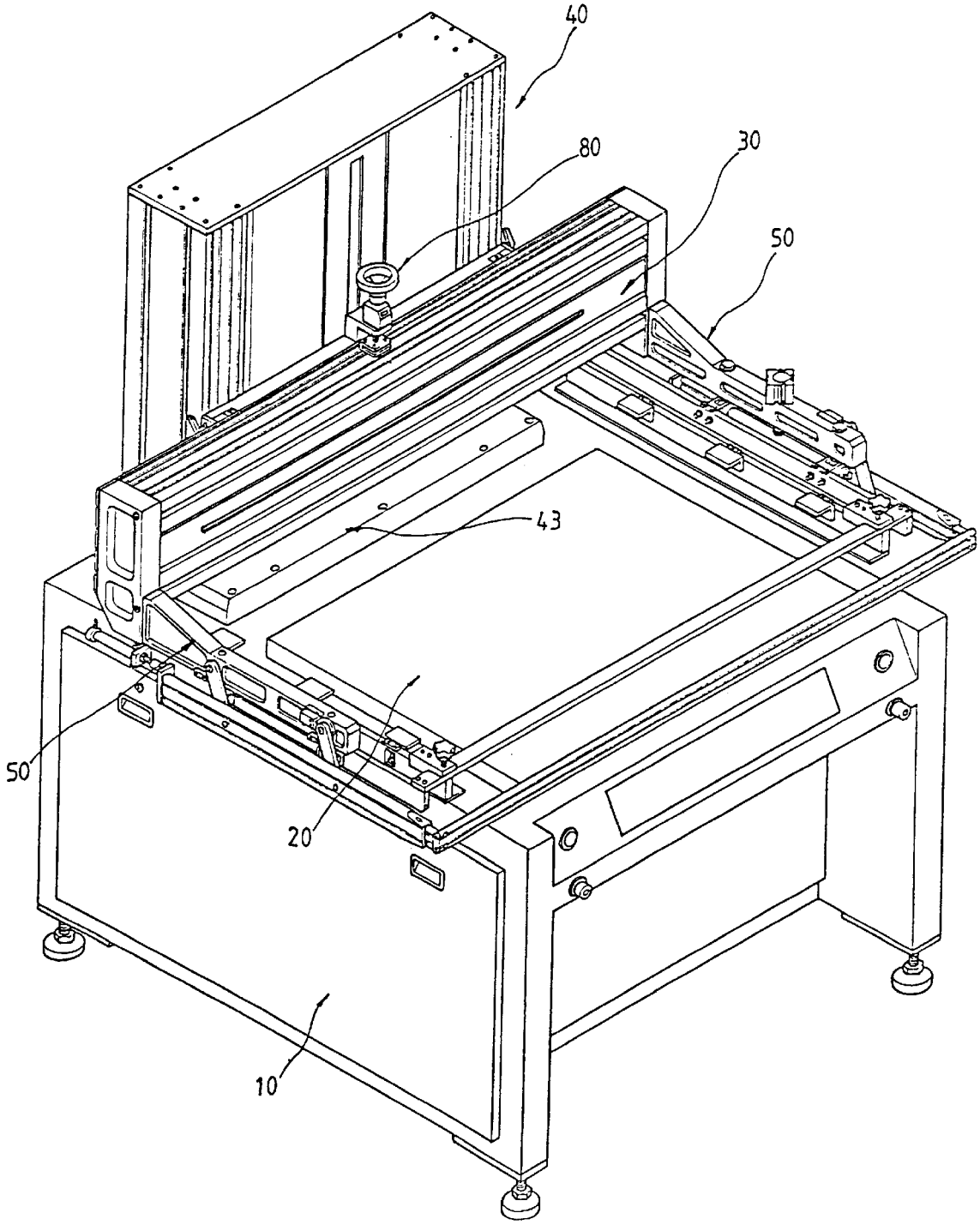
FIG. 1 is a schematic perspective of a cantilever type screen-printing machine, showing positions of the elevating mechanism and the transverse sliding assembly according to the present invention on a base of the screen-printing machine.
Figure 2:
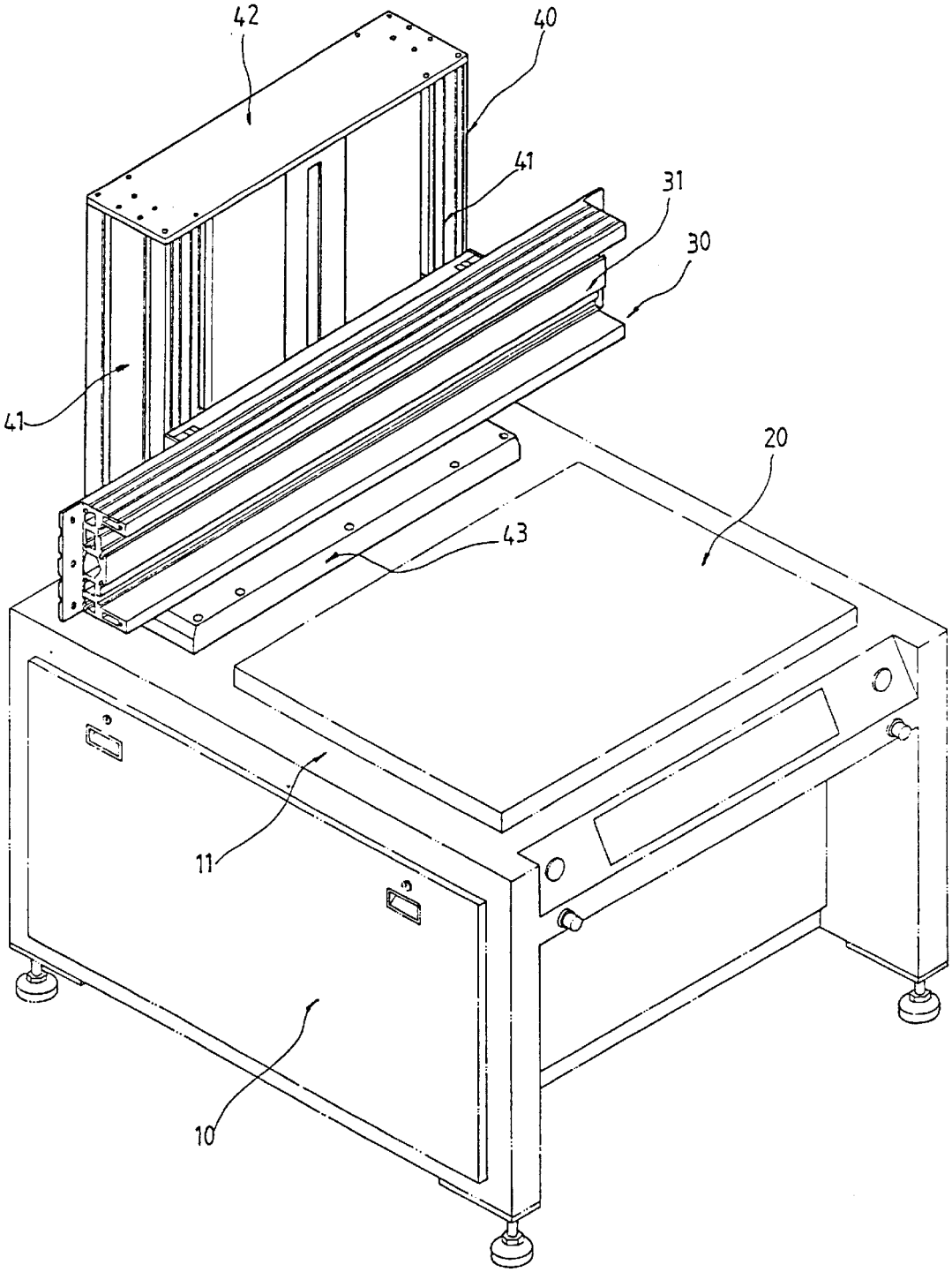
FIG. 2 is a perspective similar to that of FIG. 1 but two cantilever arms connected to two ends of the transverse sliding assembly are removed to better show an internal structure of the transverse sliding assembly.

Please refer to FIGS. 1 and 2 that are front perspective views of a cantilever type screen-printing machine. The screen-printing machine mainly includes a base 10, a print tabletop 20, a transverse sliding assembly 30, and an elevating mechanism 40. Two cantilever arms 50 and other associated components, such as screen plate holders, are connected to two lateral ends of the transverse sliding assembly 30. A print head assembly (not shown) is sideward slidably connected to and forward projected from the transverse sliding assembly 30. The tabletop 20 is located at a front portion of a top surface 11 of the base 10, and the elevating mechanism 40 is located at and upward extended from a rear portion of the top surface 11 of the base 10. The transverse sliding assembly 30 is connected to a front side of the elevating mechanism 40, such that the whole transverse sliding assembly 30 is supported by the elevating mechanism 40 to ascend and descend along and in front of the elevating mechanism 40.

Figure 3:
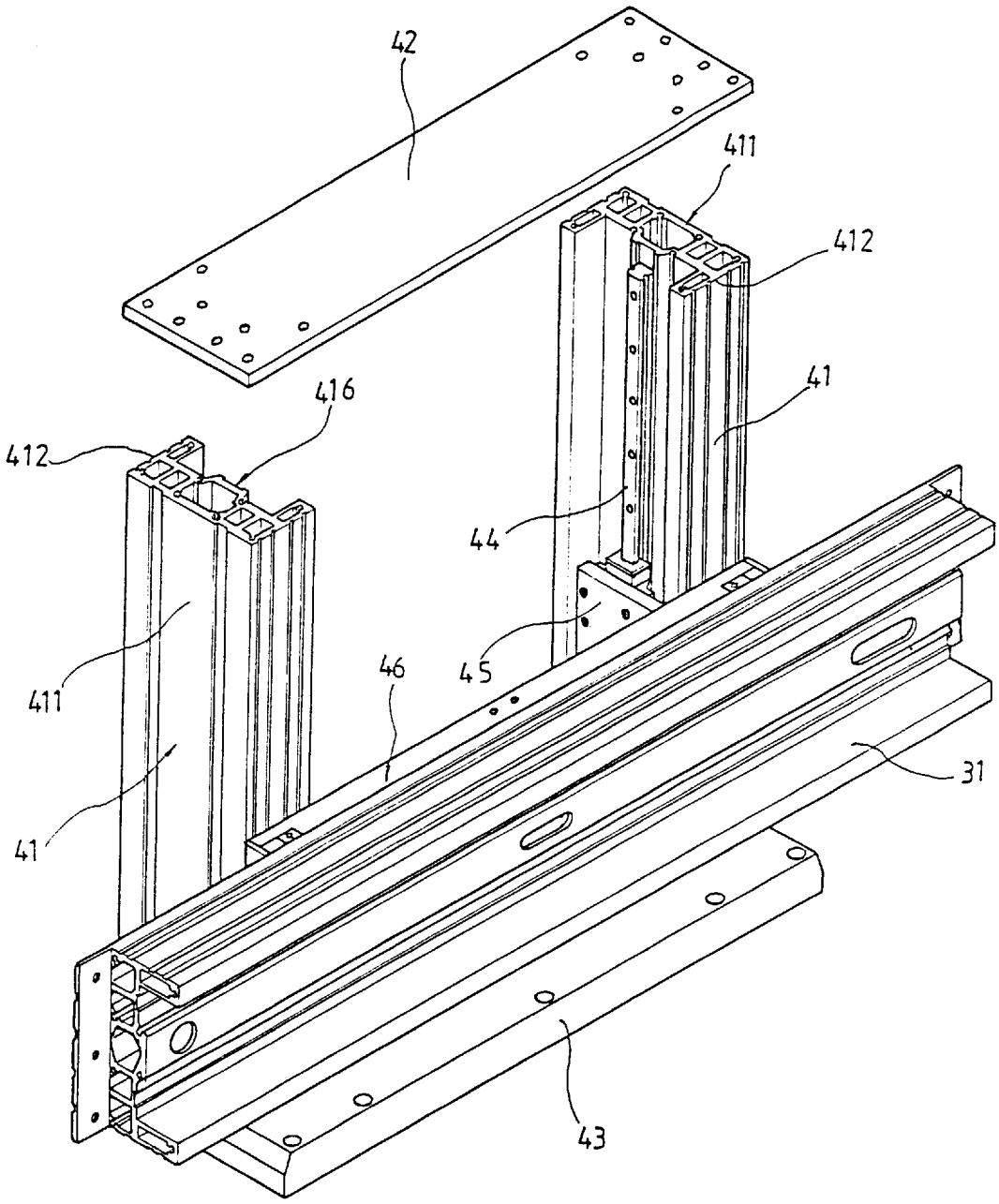
FIG. 3 is a perspective showing the manner in which the transverse sliding assembly is connected to the elevating mechanism of the present invention.
Figure 4:
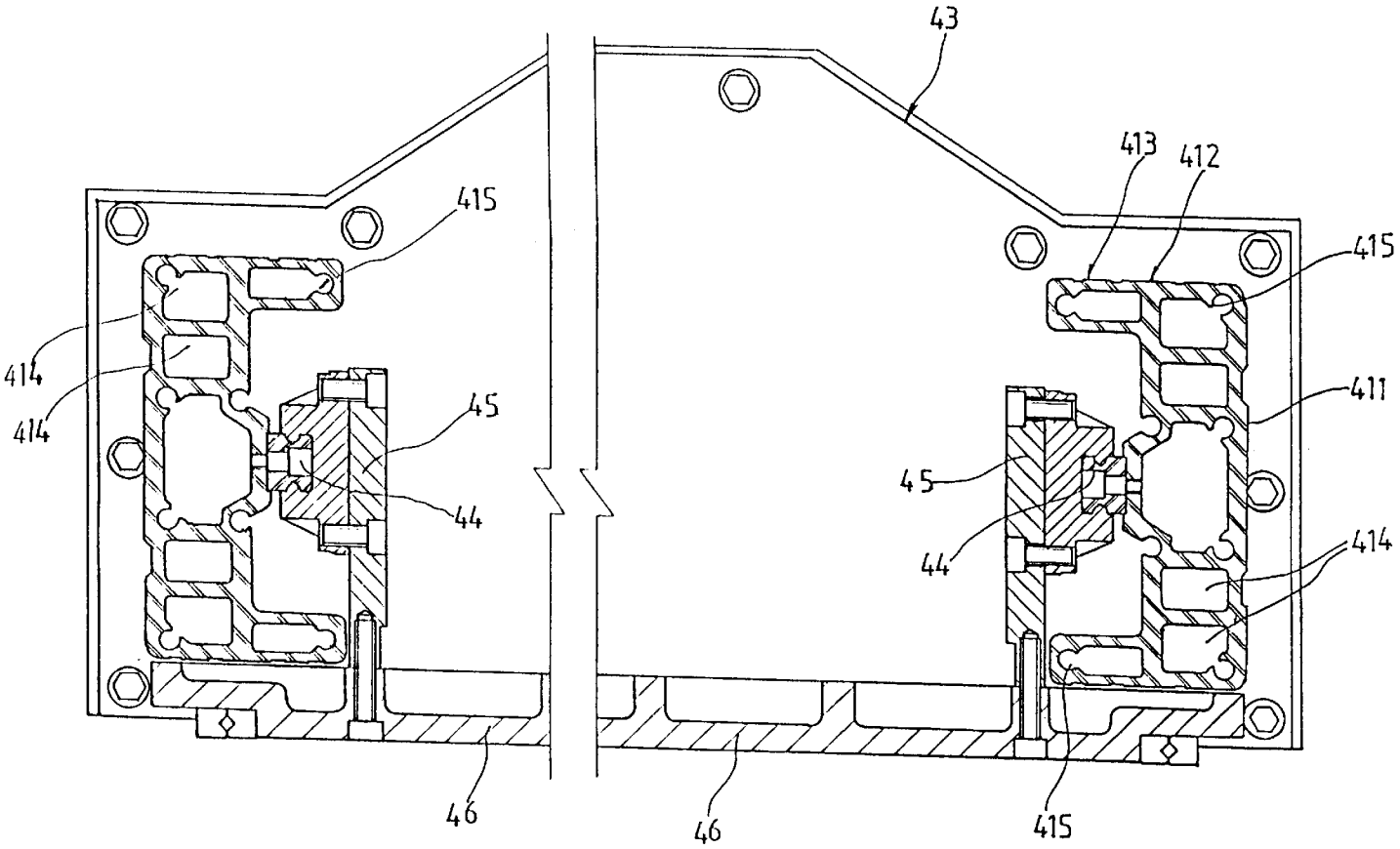
FIG. 4 is a fragmentary and enlarged top sectional view of the elevating mechanism of the present invention.
Figure 5:
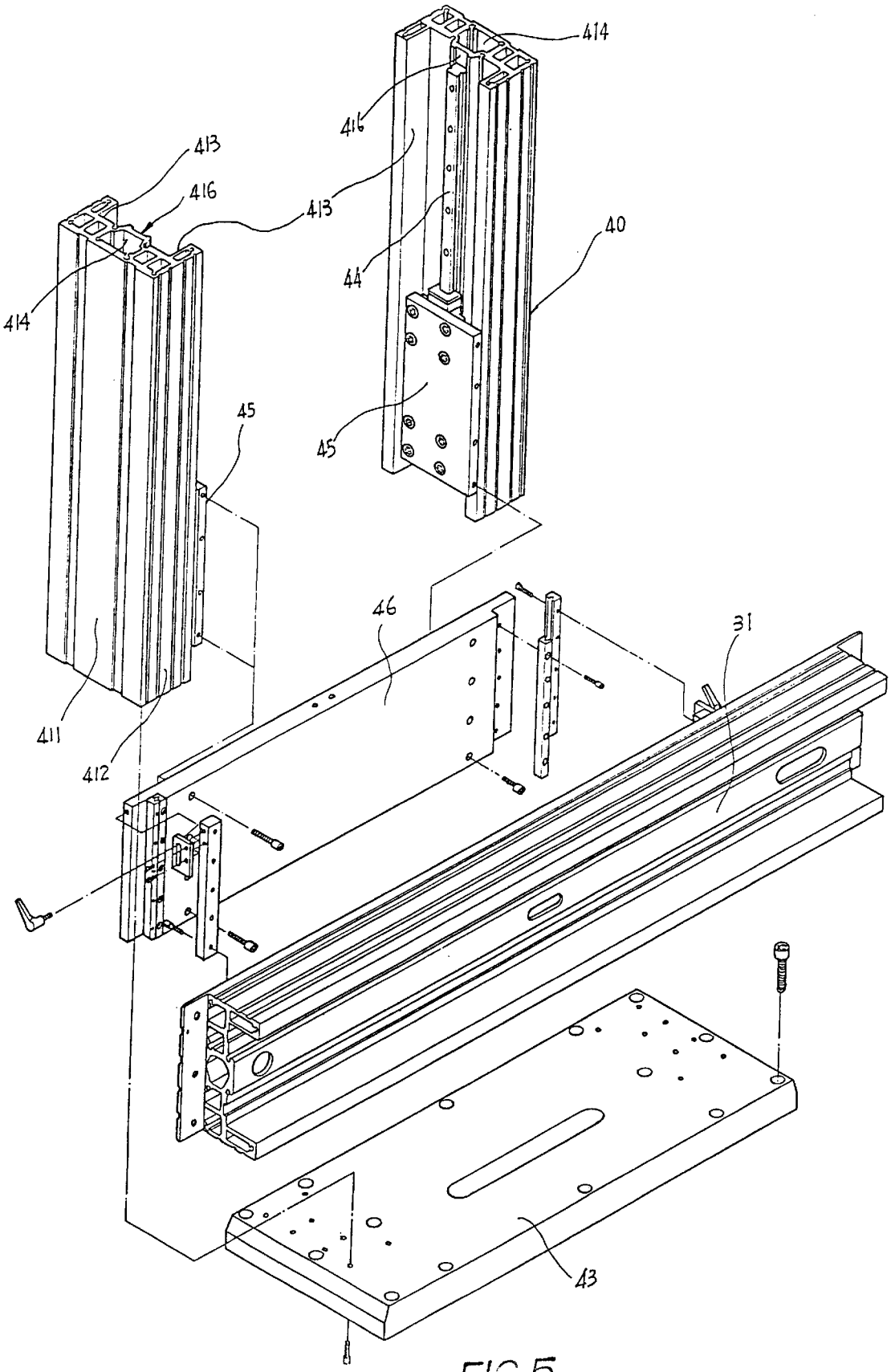
FIG. 5 is an exploded perspective of FIG. 3.
Figure 6:
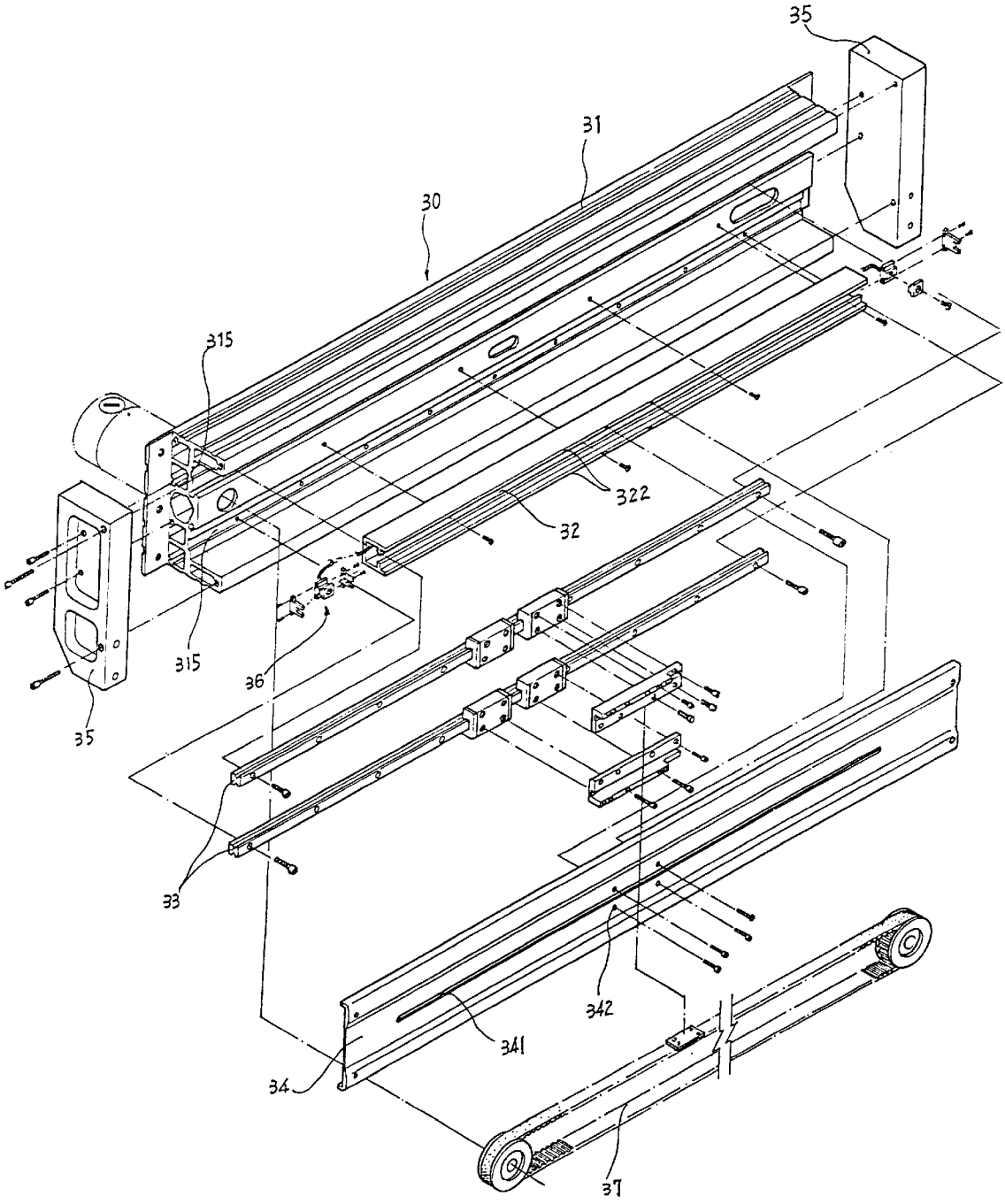
FIG. 6 is an exploded perspective of the transverse sliding assembly of the present invention.

Please further refer to FIGS. 3, 4 and 5. The elevating mechanism 40 includes two symmetrically identical and upstanding aluminum extrusion columns 41 spaced at the rear portion of the top surface 11 of the base 10. The aluminum extrusion columns 41 may be obtained by sequentially cutting a long aluminum extrusion section so that the cut aluminum extrusions have the same desired length. The aluminum extrusion sections for forming the columns 41 may be easily produced and the cutting thereof may be easily and accurately controlled to maintain good quality of resulted aluminum extrusion columns 41. As can be clearly seen from the drawings, the aluminum extrusion column 41 each preferably has a substantially C-shaped cross section with right-angled outer corners, so that the column 41 has a depth 411 larger than a width 412 thereof. Front portions of the side surfaces 412 of the column 41 form two flanges 413. A plurality of longitudinally extended hollow channels 414 are symmetrically formed inside the aluminum extrusion column 41. These hollow channels enhance an overall strength and rigidity of the column 41. The depth of the column 41 may be 3.5 times as large as a diameter of a cylindrical column as usually adopted in the conventional screen-printing machine. The aluminum extrusion column 41 has therefore a bending strength much higher than that of the conventional cylindrical column. The elevating mechanism 40 having the two aluminum extrusion columns 41 is therefore strong enough to support the whole transverse sliding assembly 30 and allow the latter to move up and down along it at a high speed without causing any vibration or forward bending of the columns 41. A plurality of longitudinally extended C-shaped grooves 415 are provided at predetermined positions in the hollow channels inside the aluminum extrusion columns 41. These grooves 415 may be internally threaded, so that a top cross beam 42 and a bottom seat 43 may be connected to upper and lower ends, respectively, of the two aluminum extrusion columns 41 by directly threading fastening means, such as screws, into desired internally threaded C-shaped grooves 415. The bottom seat 43 is thereafter screwed to the top surface 11 of the base 10, so that the two parallel and upstanding aluminum extrusion columns 41, the transverse sliding assembly 30, and the bottom seat 43 may be easily assembled together to provide a solid structure.

There is a guide channel 416 formed at an inner side of each column 41 at a middle portion between the two flanges 413. Two steel slide rails 44 are separately screwed to the guide channels 416, so that two big slides 45 are symmetrically associated with and slidable along the two steel slide rails 44. A guide block 46 is transversely connected to the two big slides 45, so that it may be brought by the two slides 45 to stably move up and down along the two aluminum extrusion columns 41.

Please now refer to FIGS. 1, 5, 6, and 7. The transverse sliding assembly 30 is so designed that a print head assembly 60 may be laterally slidably connected to a front side thereof (see FIG. 7). The transverse sliding assembly 30 mainly includes a main seat 31, a supporting member 32, two steel slide rails 33, a protective cover 34, two cantilever arm holders 35, photo switches 36, and a transfer belt 37. The main seat 31 is an aluminum extrusion member and is obtained by cutting a long aluminum extrusion section, so that it has a length adapted to dimensions of the base 10. The main seat 31 needs only simple fabrication before it can be used in the transverse sliding assembly 30. The main seat 31 also has a substantially C-shaped cross section with right-angled outer corners. Such a C-shaped cross section gives the main seat 31 a height larger than a depth thereof. Upper and lower surfaces of the main seat 31 have front portions that form two flanges 312 extended normal to a back surface 311 of the main seat 31. A plurality of transversely extended hollow channels 313 are formed inside the main seat 31 to enhance a rigidity of the aluminum extruded main seat 31. Internally threaded C-shaped grooves 314 are provided in and along the hollow channels 313, so that the two cantilever arm holders 35 may be firmly connected to two ends of the main seat 31 by extending fastening means, such as screws, into the internally threaded C-shaped grooves 314. An upper and a lower transverse guide channel 315 are symmetrically formed at a front surface of the main seat 31. The two steel slide rails 33 are separately screwed to the two guide channels 315. A flat-topped raised portion 316 transversely extends across a middle portion of the front surface of the main seat 31. The supporting member 32 is a long member having a right-angled C-shaped cross section and is screwed to a front of the flat top of the raised portion 316. Since the upper and lower steel slide rails 33, the transfer belt 37, and the print head assembly 60 are connected and operate in a manner similar to that adopted in the conventional cantilever type screen-printing machine, they are not repeatedly described herein.

The C-shaped supporting member 32 defines a front central opening 321 that aligns with a long central slot 341 formed on the protective cover 34 when the latter is mounted to close a front side of the main seat 31. The supporting member 32 also has forward projected upper and lower flanges 322 that abut against an inner surface of the protective cover 34 at positions properly above and below, respectively, the long central slot 341, so that fastening means, such as screws, may be used to lock the protective cover 34 to the flanges 322 of the supporting member 32 via through holes 342 and threaded holes correspondingly formed along the protective cover 34 and the flanges 322, respectively. The number of these holes may be decided depending on an overall length and strength of the protective cover 34, so that the protective cover 34 can be firmly and smoothly attached to the main seat 31 of the transverse sliding assembly 30 to avoid vibration and/or noise possibly produced during movement of the transverse sliding assembly 30 along the elevating mechanism 40 at high speed. Both the protective cover 34 and the supporting member 32 may be modular aluminum extrusions to facilitate convenient assembling thereof.

Since the main seat 31 and the supporting member 32 all are provided with internal hollow channels that define a lot of elongated through spaces via which wires and/or tubes may be extended and therefore be well protected. Complicate pneumatic tubes and electric conductors (not shown) may be respectively collected in different hollow channels to avoid disordered wiring while the tubes and wires may be easily accessed for maintenance purpose.

Figure 7:
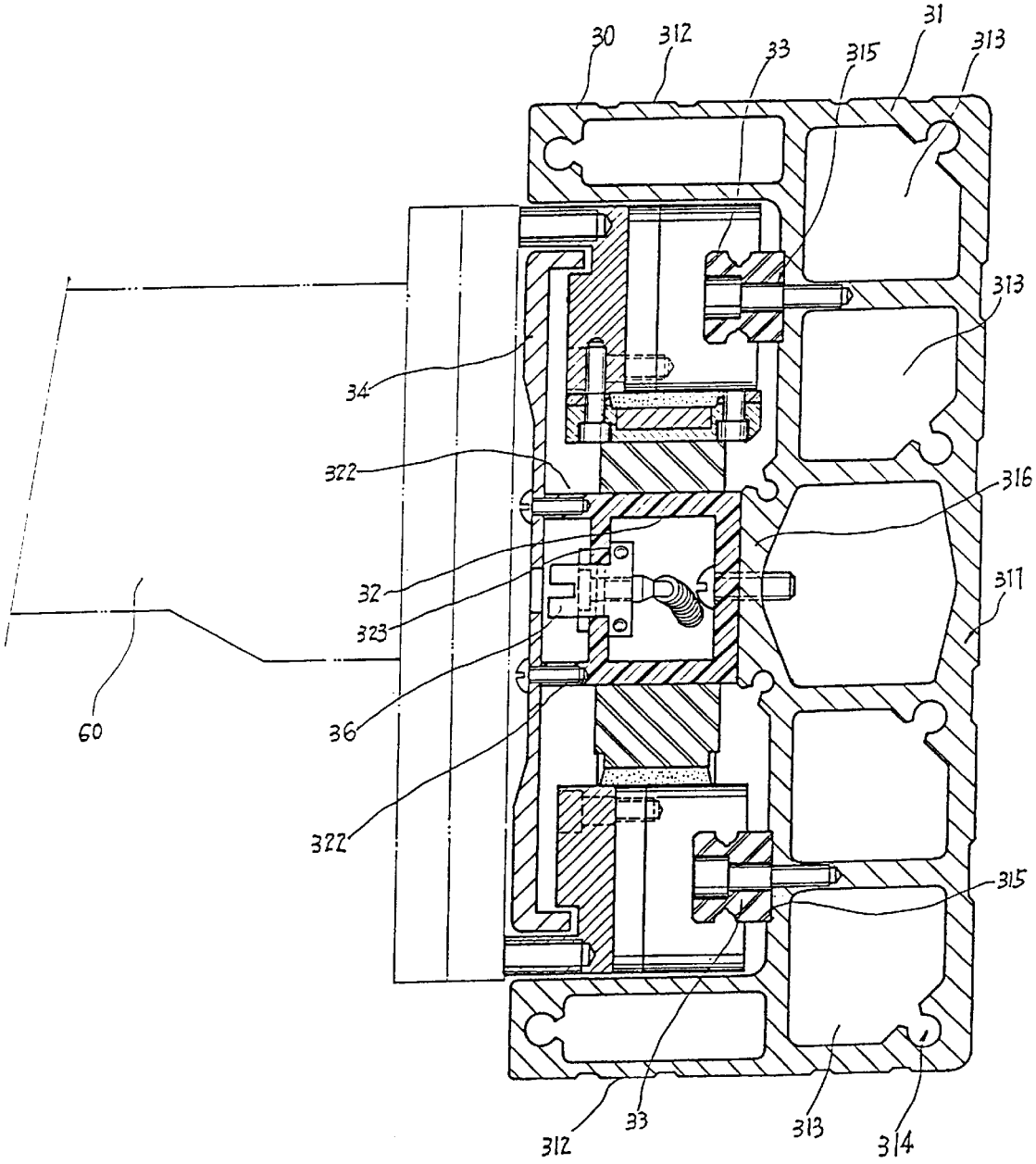
FIG. 7 is an enlarged end sectional view of the transverse sliding assembly of the present invention.
Figure 8:
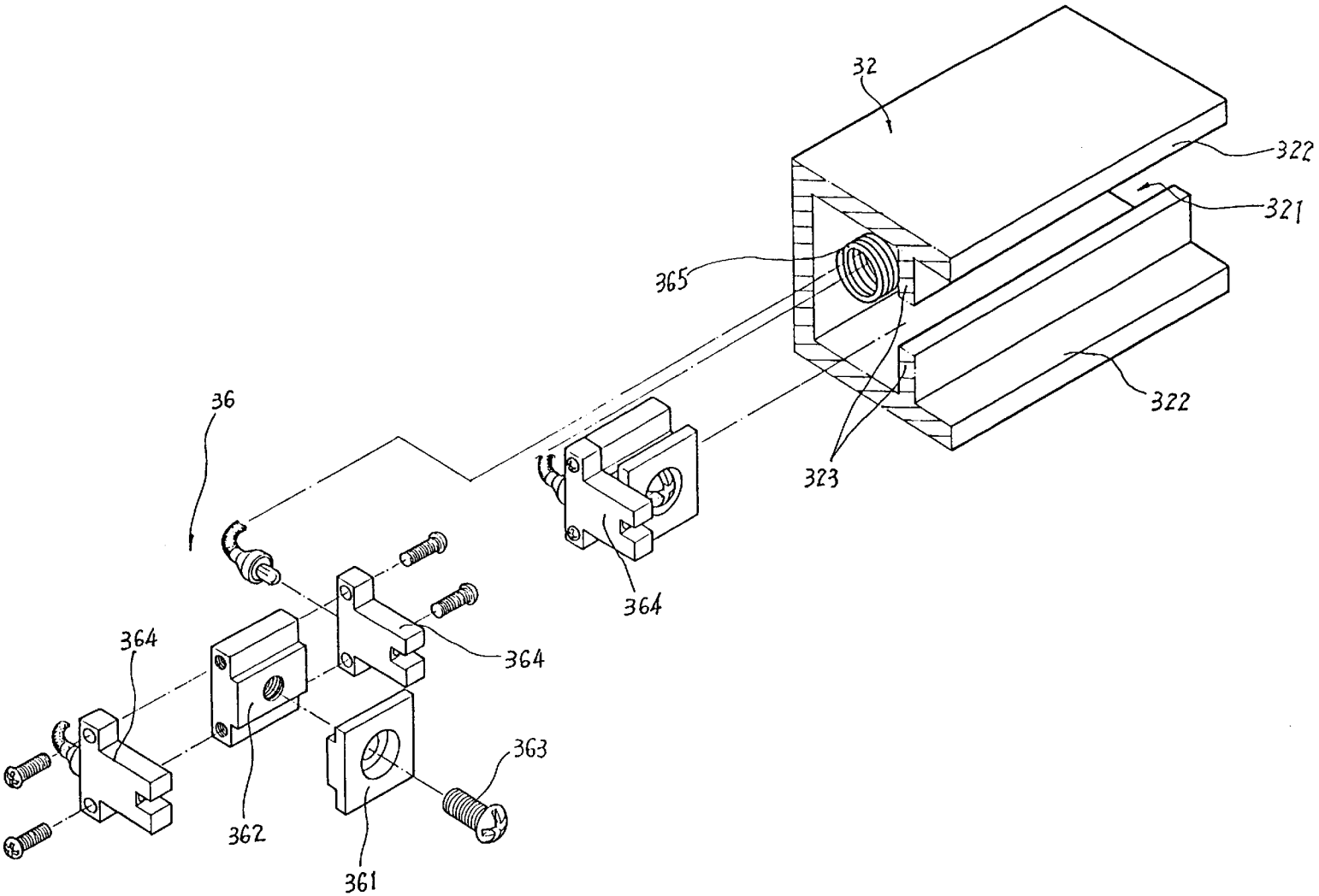
FIG. 8 is a fragmentary and exploded perspective showing the manner in which photo switches and other parts are mounted inside a supporting member in the transverse sliding assembly.

The photo switches 36 are mounted inside the supporting member 32, as shown in FIGS. 7 and 8, for controlling terminal points or buffer points in a travel of the sideward movement of the print head assembly 60. Positions of the photo switches 36 in the supporting member 32 must be adjusted according to an actual size of an article on which the printing is to be proceeded. Therefore, the photo switches 36 must be movable and should be locked to fixed points after they have been moved according to actual need, lest any operator should actuate the print head assembly 60 without knowing loosened and displaced photo switches 36 in the supporting member 32. In this condition, the actuated print head assembly 60 would undesirably collide with the screen plate holders at two outer ends of the transverse sliding assembly 30 and cause damages.

As shown in FIGS. 7 and 8, the photo switch 36 each includes a front clamping seat 361 and a rear clamping seat 362 that are separately located at outer and inner sides of the front central opening 321 of the supporting member 32 and are locked together by an adjusting screw 363 to firmly clamp walls 323 above and below the opening 321 between them. A sensor 364 is fixedly connected to one side of the rear clamping seat 362 and forward projects from the opening 321 to face the long slot 341 on the protective cover 34, so that the sensor 364 can directly detect the movement of the print head assembly 60. To change the position of the photo switch 36, an operator may simply extend a long screwdriver through the long slot 341 to loosen the adjusting screw 363 and apply a lateral force on the screw 363 to move the photo switch 36 sideward. When the photo switch 36 is moved to a new position, the adjusting screw 363 is tightened again to fix the photo switch 36 in place. The adjustment of the photo switch 36 can be accomplished only with one hand and a long screwdriver, enabling the transverse sliding assembly 30 to be very practical for use. A length of flexible wire connected to the photo switch 36 may be completely located inside the supporting member 32 to avoid tangle and/or break during any operation of the screen-printing machine. The supporting member 32 can therefore firmly support the protective cover 34, locate the photo switches 36 for easy adjustment thereof, and isolate and protect tubes and conductors routed therethrough.

The present invention also relates to a driving mechanism for driving the transverse sliding assembly 30 to vertically move up and down along the columns 41 of the elevating mechanism 40. As can be seen from FIG. 9 that is a rear perspective view of the screen-printing machine of FIG. 1, a preferred embodiment of the driving mechanism according to the present invention mainly includes a gear reduction motor 70 that generates a driving force and cooperates with the guide block 46, the aluminum extrusion columns 41, and the vertical steel slide rails 44 to ascend and descend the transverse sliding assembly 30. The gear reduction motor 70 is a commercially available product. In the preferred embodiment shown in FIG. 9, it is located in the base 10 at a rear portion below the top surface 11. The motor 70 is mounted on a seat 12 that can be forward, backward, and sideward adjusted in its position. The motor 70 has an output crank 71 pivotally connected at an outer end to a lower end of a driving bar 72. An upper end of the driving bar 72 extends through and projects from the top surface 11 of the base 10 and the bottom seat 43 of the elevating mechanism 40 to pivotally connect to a rear side of the guide block 46 at a middle point thereof. When the gear reduction motor 70 operates at high speed, the output crank 71 rotates and brings the driving bar 72 to move in circular motion at the same time. The guide block 46 pivotally connected to the driving bar 72 and the transverse sliding assembly 30 connected to the guide block 46 are therefore quickly moved up and down by the driving bar 72 in a balanced and stable manner. Since the two aluminum extrusion columns 41 of the elevating mechanism 40 have sufficient bending strength, the transverse sliding assembly 30 connected to the columns 41 through the guide block 46 can therefore move smoothly at high speed.

Figure 10:
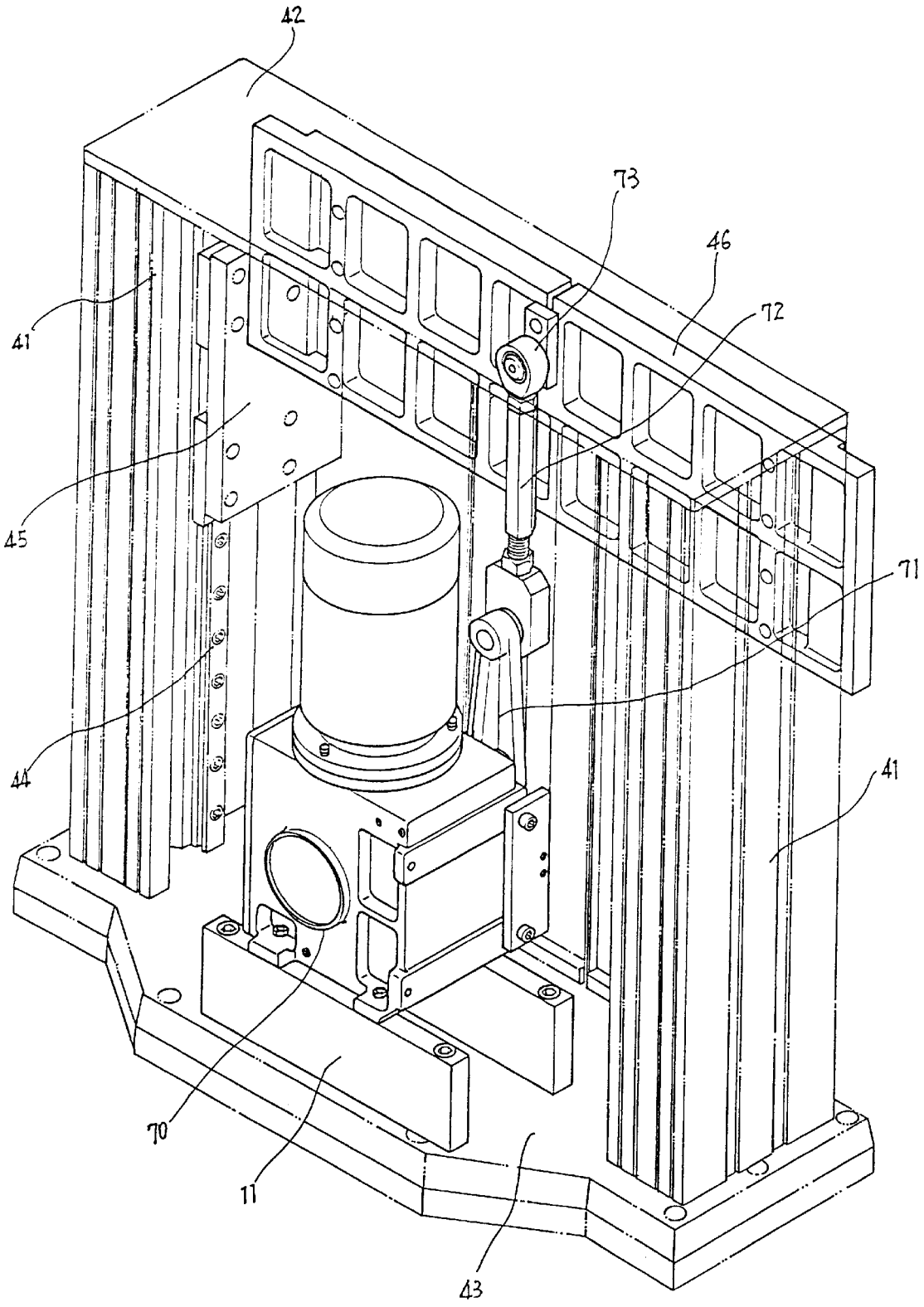
FIG. 10 is another fragmentary rear perspective view of the screen-printing machine of FIG. 1, showing another embodiment of the driving mechanism according to the present invention.

FIG. 10 illustrates another embodiment of the driving mechanism according to the present invention. In this embodiment, the driving mechanism also includes a gear reduction motor 70 that is, however, mounted on a rear portion of the top surface 11 of the base 10.

Figure 9:
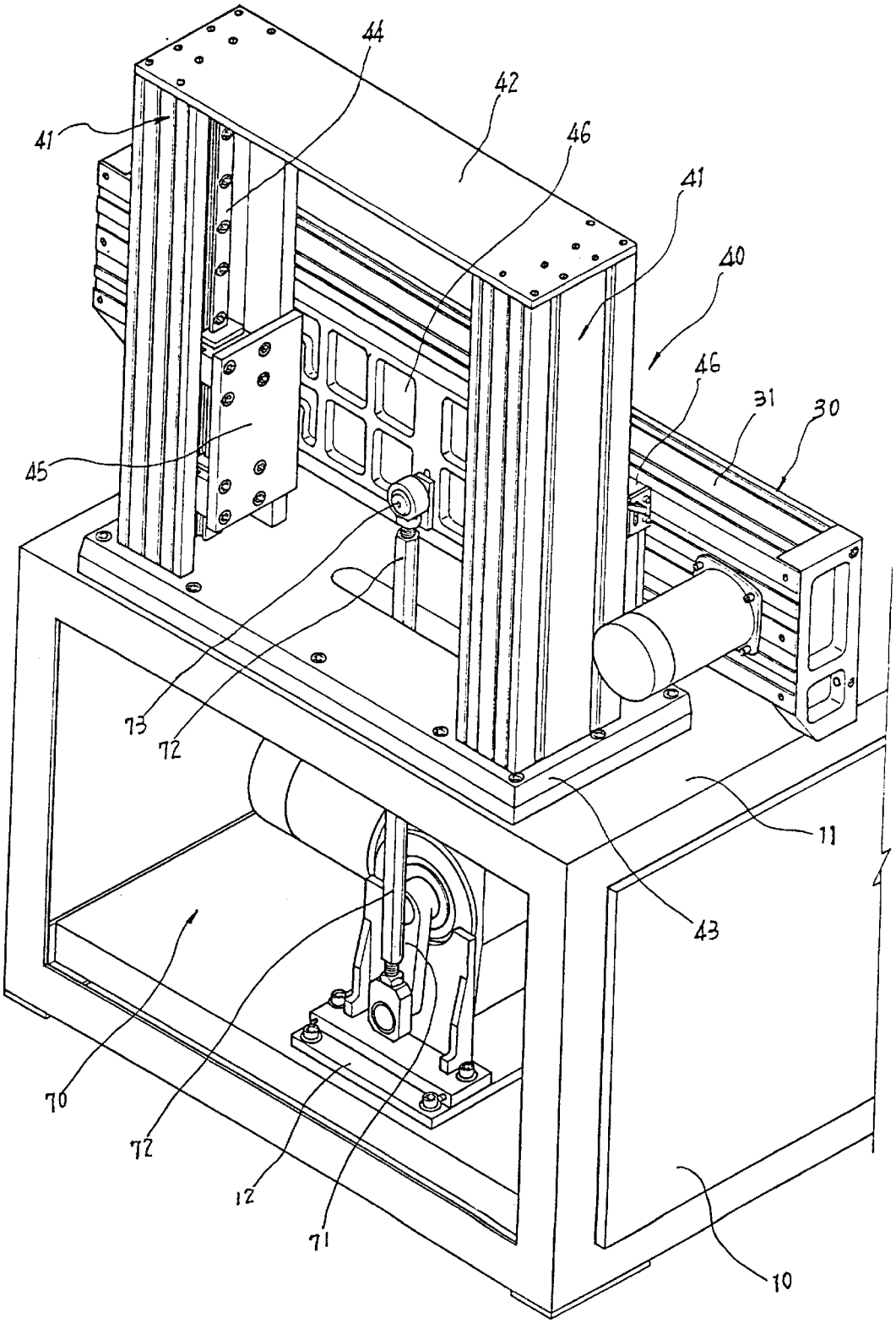
FIG. 9 is a fragmentary rear perspective view of the screen-printing machine of FIG. 1, showing a preferred embodiment of the driving mechanism according to the present invention included in the screen-printing machine.
Figure 11:
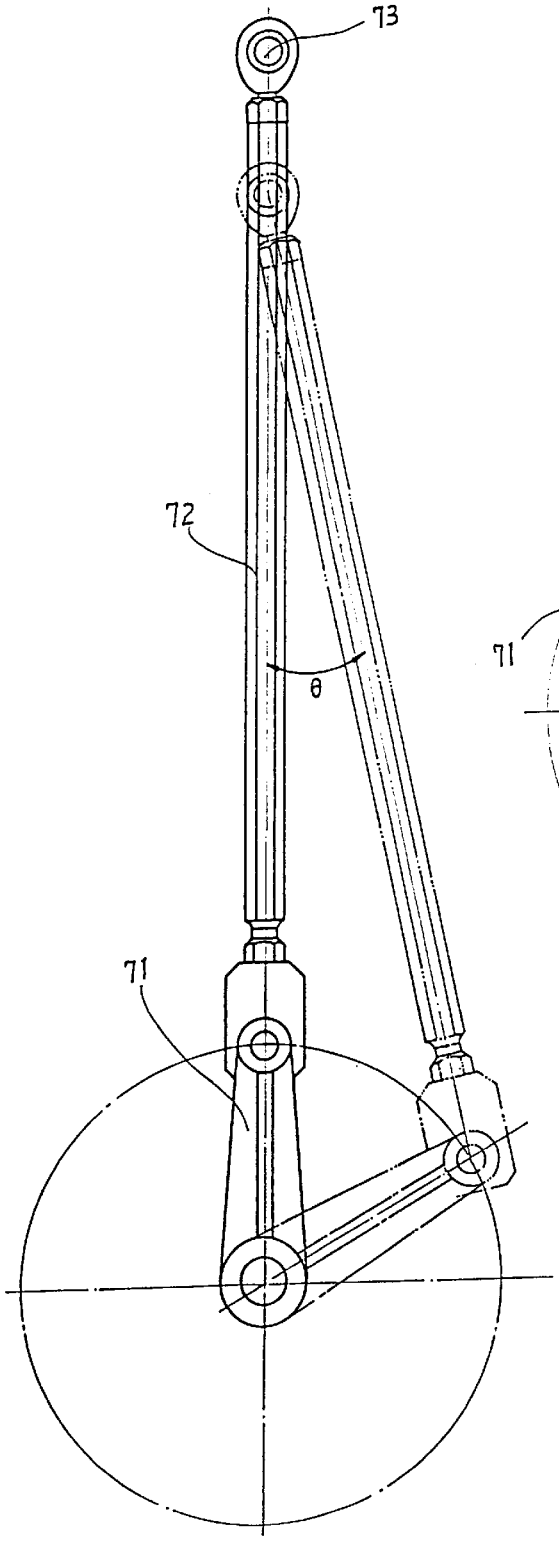
FIG. 11 is a plan view illustrating the motion of a driving bar in the driving mechanism of FIG. 9.
Figure 12:
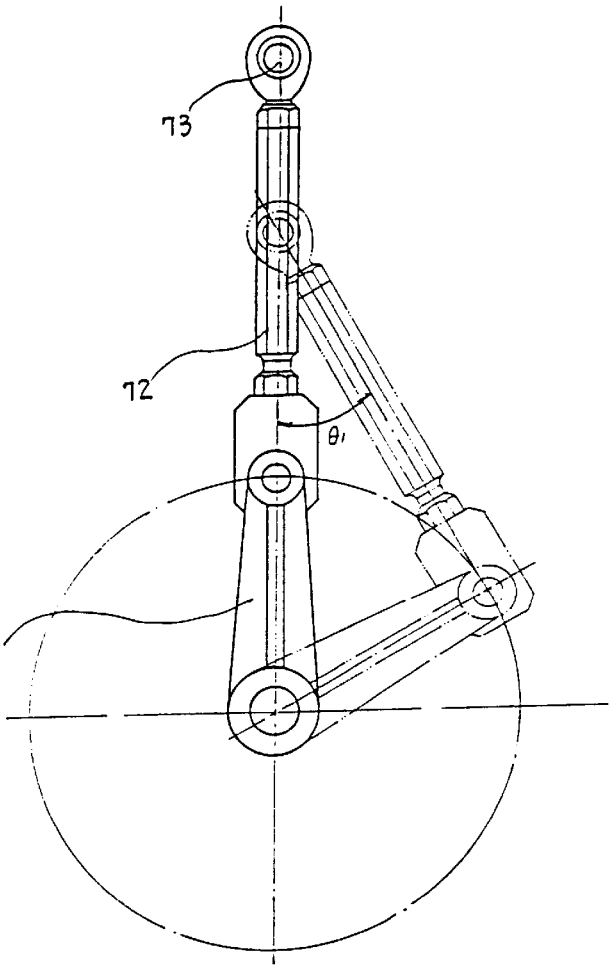
FIG. 12 is a plan view illustrating the motion of a driving bar in the driving mechanism of FIG. 10.

FIGS. 11 and 12 show motions of the driving bars 72 of the motors 70 in the embodiments of FIGS. 9 and 10, respectively. An included angle θ between the driving bar 72 and a perpendicular centerline in FIG. 11 is smaller than an included angle θ' in FIG. 12. This means when the output cranks 71 in the two embodiments have the same output, the smaller included angle θ in FIG. 11 shall enable the driving mechanism of FIG. 9 to generate an effective active force applied on a pivot 73 at the upper end of the driving bar 72 higher than that generated by the driving mechanism of FIG. 12. In other words, the driving mechanism of FIG. 9 has a mechanical power bigger than that of the driving mechanism of FIG. 10. Therefore, when the gear reduction motor 70 is disposed below the top surface 11, it shall have better brake force compared to a similar gear reduction motor 70 that is disposed on the top surface 11. Or, a gear reduction motor 70 having a smaller torsion may be disposed below the top surface 11 of the base 10 to achieve a brake force the same as that of a gear reduction motor 70 having a larger torsion but disposed on the top surface 11 of the base 10. The driving mechanism of the present invention shown in FIG. 9 is therefore more practical and economical for use than that of FIG. 10.

As can be seen from FIGS. 1 and 7, two cantilever arms 50 for holding a complete set of screen plate and the print head assembly 60 are connected to and forward projected from a front side of the transverse sliding assembly 30. When the transverse sliding assembly 30 is driven by the driving mechanism of the present invention to move up and down along the elevating mechanism 40, it is a lower terminal end in a travel of the transverse sliding assembly 30 that affects a print thickness of the screen-printing machine. The present invention therefore also relates to a fine adjustment mechanism 80 for the transverse sliding assembly 30, or a print thickness fine adjustment mechanism for the screen-printing machine.

Figure 13:
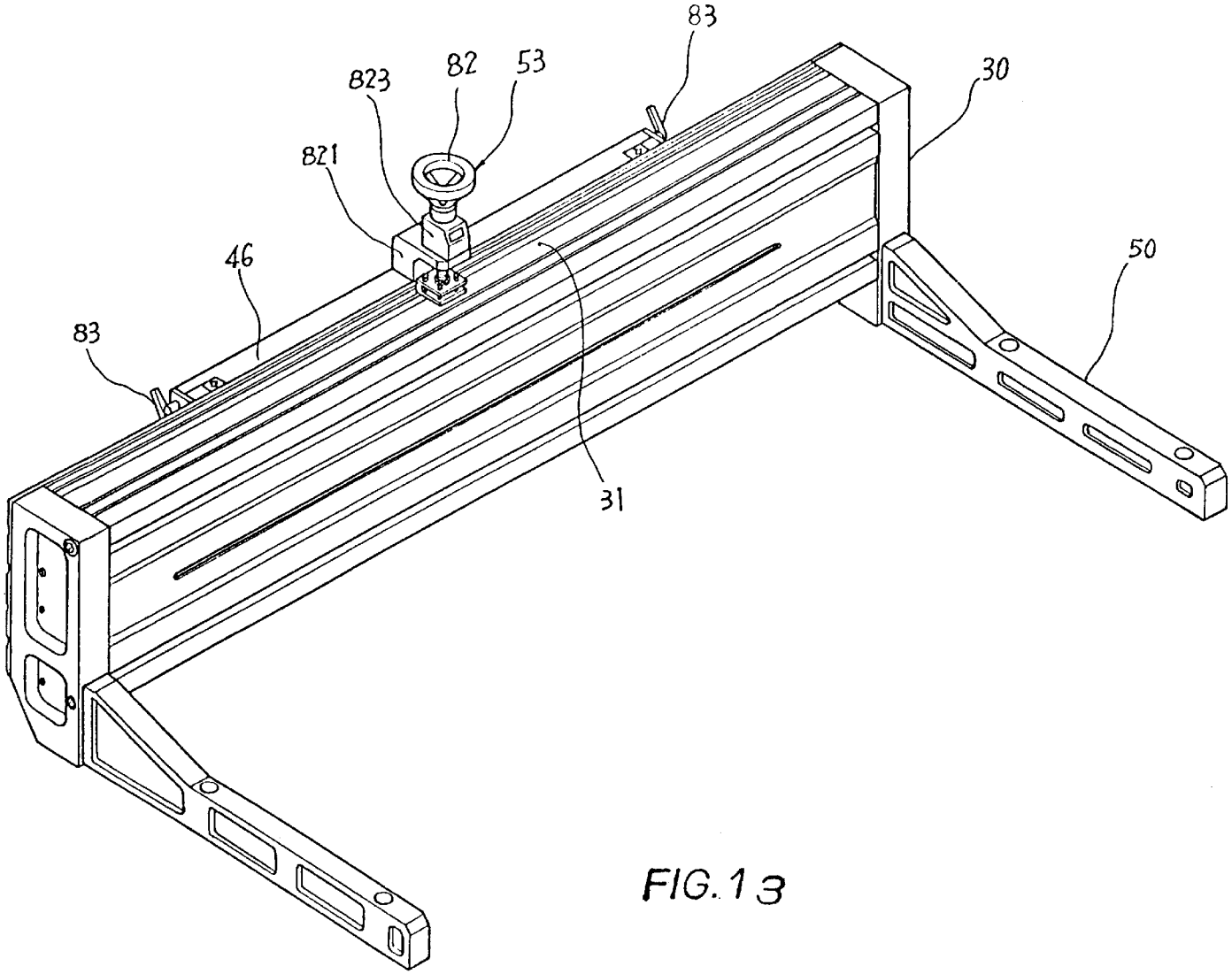
FIG. 13 is a perspective showing the location of a hand wheel assembly of the print thickness fine adjustment mechanism of the present invention.
Figure 14:
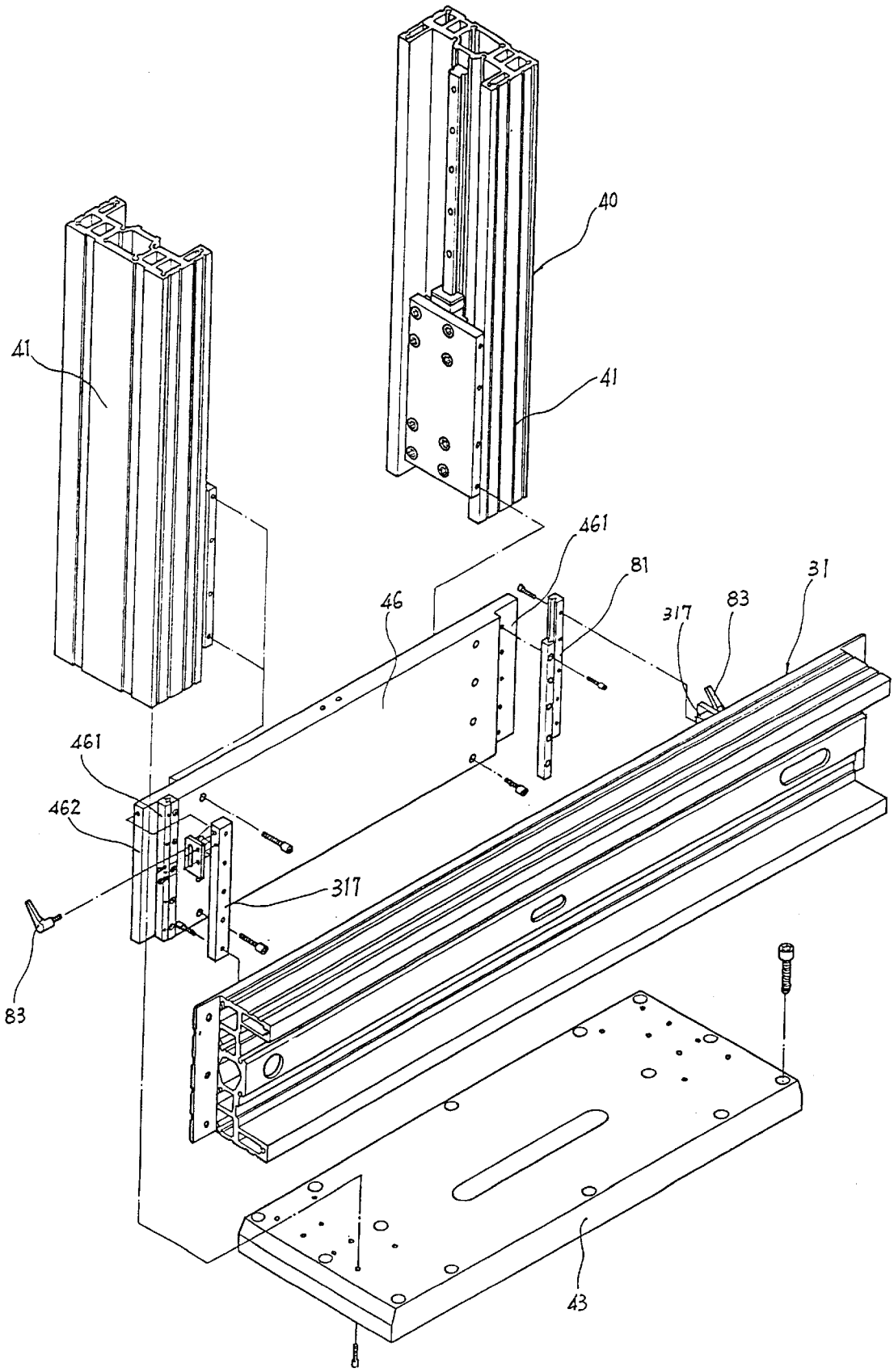
FIG. 14 is an exploded perspective showing the slide pairs and handle type locking means of the print thickness fine adjustment mechanism of the present invention.

Please refer to FIGS. 1, 13, and 14. The fine adjustment mechanism 80 of the present invention mainly includes two slide pairs 81 and a hand wheel assembly 82. The two slide pairs 81 are separately but symmetrically located between outer ends of the guide block 46 and the main seat 31 of the transverse sliding assembly 30. The slide pairs 81 are commercially available products and each pair includes two guide rails that are so associated that they can stably and smoothly slide relative to one another. The guide block 46 is formed at two outer ends with two vertically extended recesses 461 into which the slide pairs 81 are located. One of the two guide rails in each slide pair 81 is fixedly screwed to the recess 461 of the guide block 46, and the other guide rail of the slide pair 81 is fixedly screwed to a support piece 317 at a back side of the main seat 31 of the transverse sliding assembly 30. With the two slide pairs 81, the main seat 31 is closely associated with the guide block 46 and allowed to slide relative to the guide block 46. And the hand wheel assembly 82 is used to control an amount of movement of the main seat 31 relative to the guide block 46.

Figure 15:
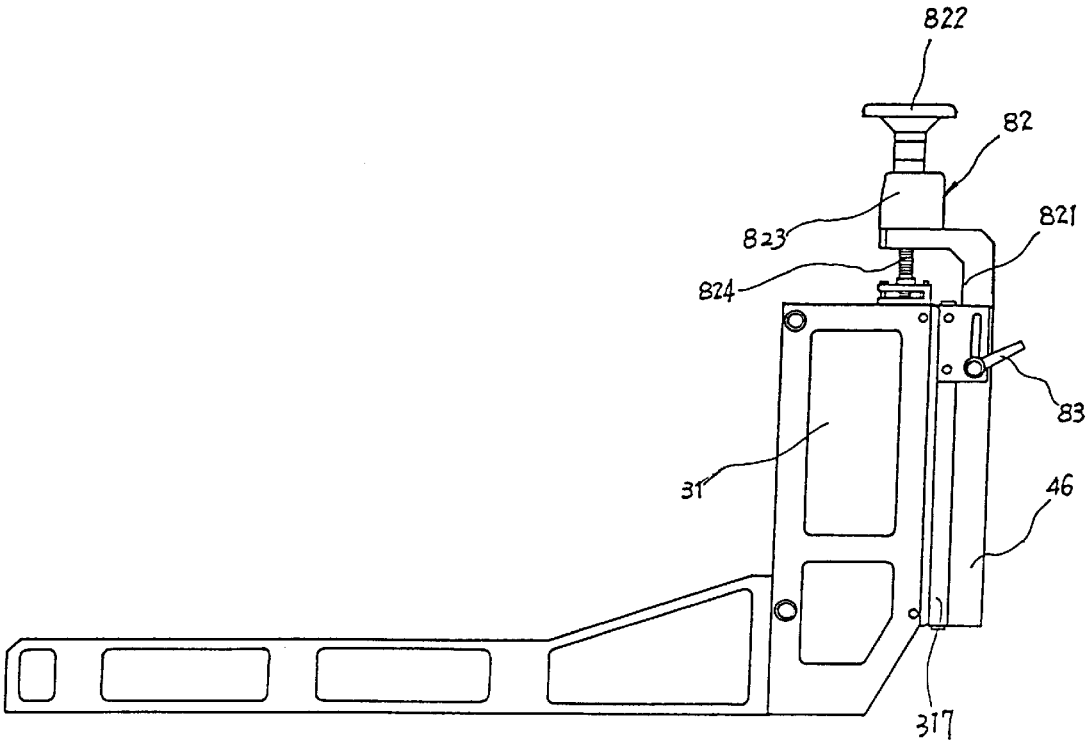
FIG. 15 is an end view of the print thickness fine adjustment mechanism of the present invention, showing the transverse sliding assembly is adjusted to a higher position relative to the guide block.
Figure 16:
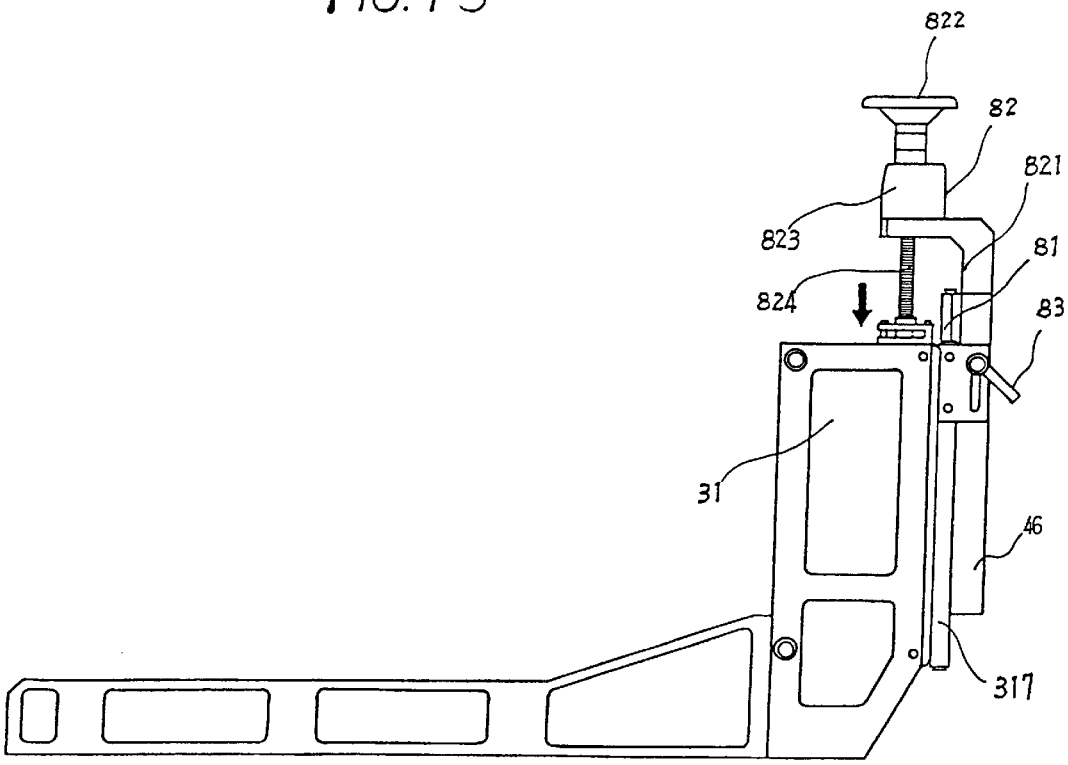
FIG. 16 is another end view of the print thickness fine adjustment mechanism of the present invention, showing the transverse sliding assembly is adjusted to a lower position relative to the guide block.

Please refer to FIGS. 15 and 16, the hand wheel assembly 82 mainly includes a reversed L-shaped bracket 821 mounted to a top middle portion of the guide block 46 with a head portion located above the main seat 31, and a wheel 822 mounted on the head portion of the bracket 821 with a screw rod 824 downward extended from the wheel 822 to pivotally connect to a top of the main seat 31. By turning the wheel 822 clockwise or counterclockwise, the screw rod 824 shall bring the main seat 31 to move up or down relative to the guide block 46. A digital meter 823 may be provided at a lower part of the wheel 822 to indicate digital data representing a vertical displacement of the main seat 31 caused by turning the wheel 822. With the digital meter 823, an operator can easily manipulate the hand wheel assembly 81 to complete the fine adjustment of vertical position of the transverse sliding assembly 30 relative to the table top 20 of the screen-printing machine.

And, to avoid vibration during vertical movement of the transverse sliding assembly 30 at high speed that would possibly affect the close association of the guide block 46 with the main seat 31, handle type locking means 83 are provided to outer sides of the support pieces 317 to control and adjust the tightness of the connection of the guide block 46 to the main seat 31. That is, by tightening or loosening the handle type locking means 83, the guide block 46 may be completely locked to the main seat 31 or slidably associated with the main seat 31. More particularly, the handle type locking means 83 are loosened before proceeding the fine adjustment of the vertical position of the main seat 31 and tightened again after the fine adjustment. The fine adjustment of the transverse sliding assembly 30 can therefore be easily controlled with the arrangements provided by the present invention.

What is claimed is:

1. A sliding mechanism and a driving mechanism thereof for a cantilever type screen-printing machine, comprising an elevating mechanism, a transverse sliding assembly, a driving mechanism, and a print thickness fine adjustment mechanism;

said elevating mechanism including two identical and upstanding aluminum extrusion columns symmetrically spaced at a predetermined distance, two steel slide rails and associated slides being symmetrically mounted to inner sides of said two columns for a guide block to transversely connect at two outer ends to said two slides;

said transverse sliding assembly including a main seat made of an aluminum extrusion, said aluminum extrusion providing internal transverse hollow channels in which other necessary parts may be accommodated or mounted; said transverse sliding assembly being connected to said two columns of said elevating mechanism via said guide block and two slide pairs mounted to two outer ends of said guide block;

said driving mechanism including a gear reduction motor that provides necessary driving force to move the transverse sliding assembly, said gear reduction motor having an output crank that is connected at an outer end to a lower end of a driving bar, and an upper end of said driving bar upward extending through and projecting from a top surface of a base of said screen-printing machine to pivotally connect to a back middle portion of said guide block, so that said guide block is brought by said driving bar, and accordingly the transverse sliding assembly, to move up and down; and said print thickness fine adjustment mechanism including said two slide pairs mounted to two outer ends of said guide block and a hand wheel assembly mounted to a head portion of said guide block to locate above said main seat of said transverse sliding assembly; each said slide pair including two associated guide rails separately screwed to said guide block and said main seat, said two guide rails being slidable relative to one another and therefore allow said main seat of said transverse sliding assembly to move up and down relative to said guide block; a wheel included in said hand wheel assembly being turnable to finely adjust a vertical position of said main seat of said transverse sliding assembly relative to said guide block, and accordingly a print thickness available on said screen-printing machine.

2. A sliding mechanism and a driving mechanism thereof for a cantilever type screen-printing machine as claimed in claim 1, wherein said elevating mechanism further includes a transverse top beam mounted to tops of said two columns of said elevating mechanism and a bottom seat screwed onto said top surface of said base of said screen-printing machine for said two aluminum extrusion columns to erect thereon; and wherein said aluminum extrusion columns each has a substantially C-shaped cross section with right-angled corners to provide a depth larger than a width of said aluminum extrusion column, said aluminum extrusion columns being located on said bottom seat with a longer side extending in a direction the same as a longitudinal direction of said top surface of said base of said screen-printing machine, and said aluminum extrusion columns having longitudinally extended internal hollow channels that give said columns enhanced bending strength and internally threaded C-shaped grooves formed along some of said internal hollow channels for said transverse top beam and said bottom seat to connect to said columns by screws threaded into said internally threaded C-shaped groves.

3. A sliding mechanism and a driving mechanism thereof for a cantilever type screen-printing machine as claimed in claim 2, wherein said two columns of said elevating mechanism are obtained by cutting a long aluminum extrusion into sections having the same desired length, and wherein said internal hollow channels and said C-shaped grooves in said aluminum extrusion for forming said columns are designed to meet necessary strength requirements.

4. A sliding mechanism and a driving mechanism thereof for a cantilever type screen-printing machine as claimed in claim 1, wherein said transverse sliding assembly further includes two steel slide rails, a supporting member having a substantially C-shaped cross section with right-angled corners, photo switches, and a protective cover; and wherein said main seat of said transverse sliding assembly is a length of aluminum extrusion having a substantially C-shaped cross section with right-angled outer corners, said aluminum extrusion forming said main seat having transversely extended internal hollow channels into which some necessary parts of said screen-printing machine, such as pneumatic tubes, electric conductors, and a belt conveyor are mounted, and internally threaded C-shaped grooves provided in and along some of said internal hollow channels for two cantilever arms holders of said screen-printing machine to mount to two outer ends of said main seat by threading screws into said internally threaded C-shaped grooves; said two steel slide rails being transversely mounted to a front side of said main seat separately at an upper and a lower position thereof, said front side of said main seat having a flat-topped raised portion extending a full length of said main seat for said supporting member to mount thereon; and said protective cover being fixed to forward projected upper and lower flanges of said C-shaped supporting member to cover a front surface of said main seat by threading screws into said upper and lower flanges at adequate intervals, and a long slot transversely formed on said protective cover being aligned with a front opening defined by said C-shaped supporting member, such that said photo switches and their associated wires may be mounted in said C-shaped supporting member and projected from said front opening to detect movement of a print head assembly of said screen-printing machine via said long slot on said protective cover.

5. A sliding mechanism and a driving mechanism thereof for a cantilever type screen-printing machine as claimed in claim 4, wherein said photo switches each includes a front clamping seat, a rear clamping seat, and a sensor; said front and said rear clamping seats being separately located at outer and inner sides of said front opening of said supporting member and locked together by an adjusting screw to firmly clamp walls above and below said front opening between them, said sensor being fixedly connected to one side of said rear clamping seat and forward projecting from said front opening of said supporting member to face said long slot on said protective cover, whereby said photo switches may be easily adjusted in positions simply by extending a long screwdriver through said long slot to loosen said adjusting screws and applying a lateral force on said adjusting screws to move said photo switches sideward before tightening said adjusting screws again.

6. A sliding mechanism and a driving mechanism thereof for a cantilever type screen-printing machine as claimed in claim 1, wherein said gear reduction motor of said driving mechanism is disposed in said base of said screen-printing machine at rear portion below said top surface of said base, and said gear reduction motor being mounted on a seat that can be forward, backward, and sideward adjusted in its position, so that said gear reduction motor may be easily located at a most suitable position in said base of said screen-printing machine.

7. A sliding mechanism and a driving mechanism thereof for a cantilever type screen-printing machine as claimed in claim 1, wherein said hand wheel assembly of said print thickness fine adjustment mechanism further includes a screw rod downward extended from said wheel to pivotally connect to a top of said main seat of said transverse sliding assembly, whereby when said wheel is turned clockwise or counterclockwise, said screw rod shall bring said main seat to finely move up or down relative to said guide block.

8. A sliding mechanism and a driving mechanism thereof for a cantilever type screen-printing machine as claimed in claim 1, wherein said print thickness fine adjustment mechanism further includes two handle type locking means mounted on said main seat of said transverse sliding assembly at positions near two outer ends of said guide block, whereby by easily manipulating said handle type locking means, said main seat and said guide block can be either firmly screwed together to allow stable movement of said transverse sliding assembly along said elevating mechanism or slightly loosened from one another to allow fine adjustment of position of said main seat relative to said guide block.

9. A sliding mechanism and a driving mechanism thereof for a cantilever type screen-printing machine as claimed in claim 1, where in said print thickness fine adjustment mechanism further includes a digital meter provided below said wheel of said hand wheel assembly for indicating amount of fine adjustment in digits.

* * * * *